United States Patent [19]

Fukui

[11] Patent Number: 4,543,588

[45] Date of Patent: Sep. 24, 1985

[54] DOT PRINTER

[75] Inventor: Hiroshi Fukui, Yokosuka, Japan

[73] Assignee: Canon Kabushiki Kaisha, Tokyo, Japan

[21] Appl. No.: 511,171

[22] Filed: Jul. 6, 1983

[30] Foreign Application Priority Data

Jul. 17, 1982 [JP] Japan ..... 57-124764

[51] Int. Cl.[4] ..... B41J 1/24

[52] U.S. Cl. ..... 346/76 PH; 219/216

[58] Field of Search ..... 346/76 PH, 76 R, 163, 346/162, 164; 400/120–126, 72; 219/216; 101/93.04, 93.05

[56] References Cited

U.S. PATENT DOCUMENTS 4,113,391 9/1978 Minowa ..... 346/76

4,143,980 3/1979 Giebler et al. ..... 400/320

*Primary Examiner*—E. A. Goldberg

*Assistant Examiner*—A. Evans

*Attorney, Agent, or Firm*—Fitzpatrick, Cella, Harper & Scinto

[57] ABSTRACT

In a dot printer having a print head with m print elements arranged in a line for printing a character dot pattern of n columns by m rows, the character dot pattern is configured such that the number of dots in any one columns of the dot character pattern is less than m.

9 Claims, 11 Drawing Figures

DOT PRINTER

BACKGROUND OF THE INVENTION

1. Field of the Invention

The present invention relates to a dot printer, and more particularly to a dot printer capable of reducing a density difference among printed characters and printing characters at a high speed.

2. Description of the Prior Art

In a prior art thermal dot printer which prints characters by a head having a plurality of heat generating resistive elements, one for each dot, the thermal head comprises, for example, seven heat generating resistive elements arranged in a line. When a character is to be printed by such a thermal head, a predetermined number of heat generating resistive elements generate heat depending on the particular character to be printed. As the number of heat generating resistive elements simultaneously energized changes, the ratio of the internal resistance of a power supply such as a dry cell which supplies power to the heat generating resistive elements, to the resistance of the plurality of heat generating resistive elements changes. As a result, the voltage applied to the heat generating resistive elements changes and the print density varies.

The print density in such a thermal dot printer is determined by the heat generated by the dots. In order to attain a uniform print density, it is necessary to keep the heat per dot of the thermal head constant.

$$W = \frac{V^2 t}{R}$$

where R(Ω) is a resistance, V(volt) is a voltage applied to the respective dot and t(ms) is a heating time.

Assuming that the resistance per dot is 11Ω and the heat per dot is 2.1 mJ, the voltage applied to the head and the heating time have a relation shown in FIG. 1. When a manganese cell or an alkali manganese cell is used as a power supply, the following phenomena are observed.

(1) The saturation voltage of the driver used changes as the electromotive force drops.

(2) The internal resistance of the dry cell increases as the electromotive force drops.

(3) The voltage applied to the head changes as the load changes due to a change in the number of dots which simultaneously generate heat.

(4) The electromotive force of the dry cell is recovered when it is left unloaded. The recovery voltage under no load is larger as the electromotive force drops.

Because of those factors, the print density varies. Since the ratio of the internal resistance of the dry cell to the impedance of the printer changes as the number of dots which simultaneously generate heat changes, the voltage applied to the head during the print operation significantly changes. An example of a relation between the number of heat generating dots and the resistance of the printer is shown below.

| Printer Operation | Printer Resistance R |
|---|---|
| voltage check (4-phase excitation) | 7.5 Ω |
| 1-dot printing (2-phase excitation + 1 dot) | 6.3 Ω |
| 2-dot printing (2-phase excitation + 2 dots) | 4.0 Ω |
| 3-dot printing (2-phase excitation + 3 dots) | 2.9 Ω |

-continued

| Printer Operation | Printer Resistance R |
|---|---|
| 4-dot printing (2-phase excitation + 4 dots) | 2.3 Ω |
| 5-dot printing (2-phase excitation + 5 dots) | 1.9 Ω |
| 6-dot printing (2-phase excitation + 6 dots) | 1.6 Ω |
| 7-dot printing (2-phase excitation + 7 dots) | 1.4 Ω |
| Remarks | 4-phase pulse motor winding resistance: 30 Ω/phase 1 × 7 thermal head 11 Ω/dot |

FIG. 2 illustrates the change of net voltage applied to the head as the load impedance changes due to a change of the number of dots which simultaneously generate heat. As seen from the above table and FIG. 2, the voltage applied to the head significantly changes depending on the number of dots which simultaneously generate heat. A character font of a thermal printer incorporated in an electronic desk-top calculator is limited to numberals and symbols for an office equipment or a special purpose equipment, unlike a terminal printer. FIG. 3 shows an example of a character font used in a thermal printer of a desk-top calculator. When the dots of one vertical line of the character font shown in FIG. 3 are simultaneously energized to print the character in a conventional control method, the characters "1", "4" and "√" have unclear portions as shown in FIG. 4. In those characters, since the number of dots which are simultaneously energized is large, the net voltage applied to the head drops to 3 volts when a dry cell having an electromotive force of 6 volts is used and the number of simultaneously energized dots is seven. As a result, the print density is low. The same problem is also encountered in a wire dot printer.

In the prior art, in order to prevent the voltage drop, the heat generating resistive elements are energized sequentially one dot at a time to reduce the number of simultaneously energized dots. FIG. 5 is a time chart illustrating a timing relation between heat generating elements DT1–DT7 and energization time in printing the numeral "1" in the prior art control system. When the prior art control system (time division control system) shown in the time chart of FIG. 5 is applied to all characters, a long time is required to print one line of characters. That is, since the energization times of the respective heat generating elements are delayed by a predetermined time period from the previous one so that the respective dots are sequentially energized in a partially overlapped manner, a long print time is required to print all characters in the line. For example, when seven dots are energized, a time period of tH shown in FIG. 5 would be required in the conventional control method but a time period of 3 tH is required when three dots are "simultaneously" energized. In such a time division control method, since the dots are sequentially energized even for those characters which can be printed in the conventional control method, a long print time is required.

It has been proposed to print those characters which have a large number of simultaneously energized dots such as characters "1", "4" and "√" in the time division control method and print those characters which have a small number of simultaneously energized dots in the conventional control method so that the print density variation is reduced and the print time is shortened.

However, it is ineffective and uneconomical to switch the control method for each of 20–30 characters.

SUMMARY OF THE INVENTION

It is an object of the present invention to provide a dot printer in which the number of simultaneously energized dots of a character pattern which inherently has a large number of simultaneously energized dots is reduced so that all characters can be printed in the conventional control method and a uniform print density is attained and the print time is shortened.

It is another object of the present invention to provide a dot printer which comprises:

a head having m print elements;

memory means for storing a data to be printed by said head;

pattern generating means for generating a dot pattern of n columns by m rows for said data stored in said memory means, the number of dots in each column of said dot pattern being less than m; and drive means for driving said print elements of said head in accordance with said dot pattern generated by said pattern generating means.

It is other object of the present invention to provide a dot printer which comprises:

a head having m print elements;

memory means for storing a data to be printed by said head;

pattern generating means for generating a dot pattern of n columns by m rows for said data stored in said memory means, the number of dots in each column of said dot pattern being no more than $m \times 4/7$; and drive means for driving said print elements of said print head in accordance with said dot pattern generated by said pattern generating means.

DESCRIPTION OF THE PREFERRED EMBODIMENTS

Figure 9:
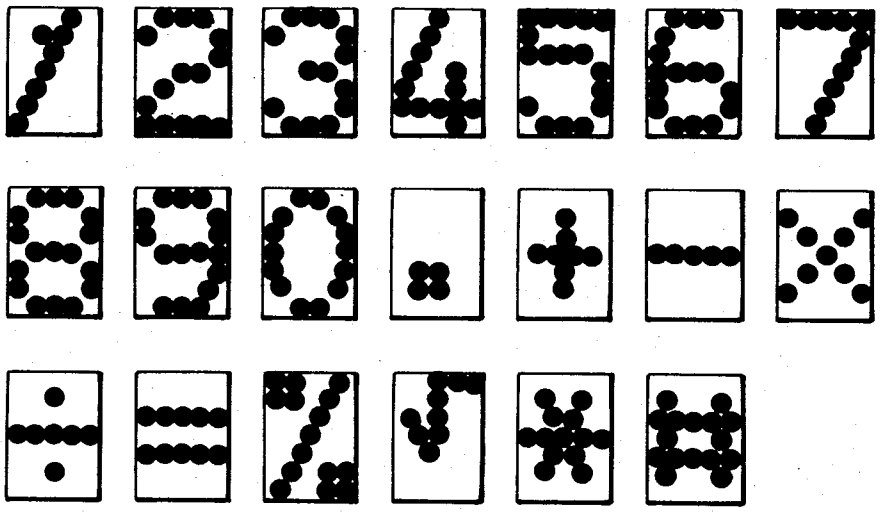
FIG. 9 shows a font having a reduced number of simultaneously energized dots.

A preferred embodiment of the present invention is now explained with reference to FIG. 6, in which numeral 1 denotes a host computer connected to a thermal printer, numeral 2 denotes a microprocessor (CPU) for controlling the thermal printer and carrying out arithmetic and logical operations, numeral 3 denotes a battery voltage detector for detecting the voltage of the power supply used, numeral 4 denotes a battery as the power supply, numeral 5 denotes a driver for driving the thermal head and driving a pulse motor to drive the thermal head, numeral 6 denotes the 4-phase pulse motor for driving the thermal head in a direction of print scan, numeral 7 denotes the thermal head having a plurality of (e.g. seven) heat generating resistive elements arranged vertically, numeral 8 denotes a random access memory (RAM) for storing print data supplied from the host computer 1, and numeral 9 denotes a read-only memory (ROM) which contains a program for controlling the CPU 2 and character patterns having a small number of simultaneously energized dots as shown in FIG. 9. The ROM 9 also contains heating time data for determining an optimum heating time depending on the number of simultaneously energized dots. $S_1$, $S_2$, $S_3$, and $S_4$ denote signal lines.

Figure 6:
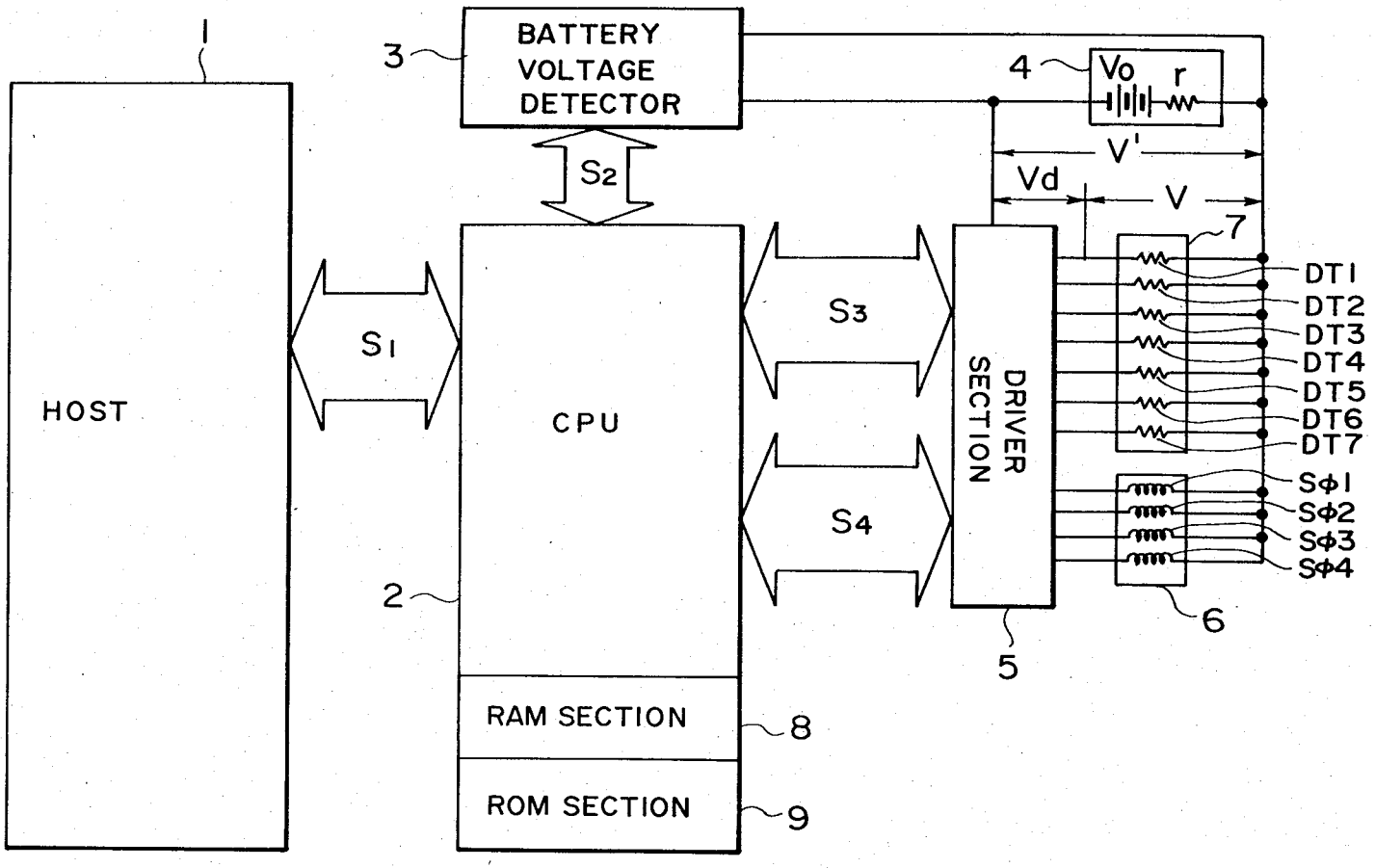
FIG. 6 is a block diagram of a thermal printer in accordance with one embodiment of the present invention.
Figure 7B:
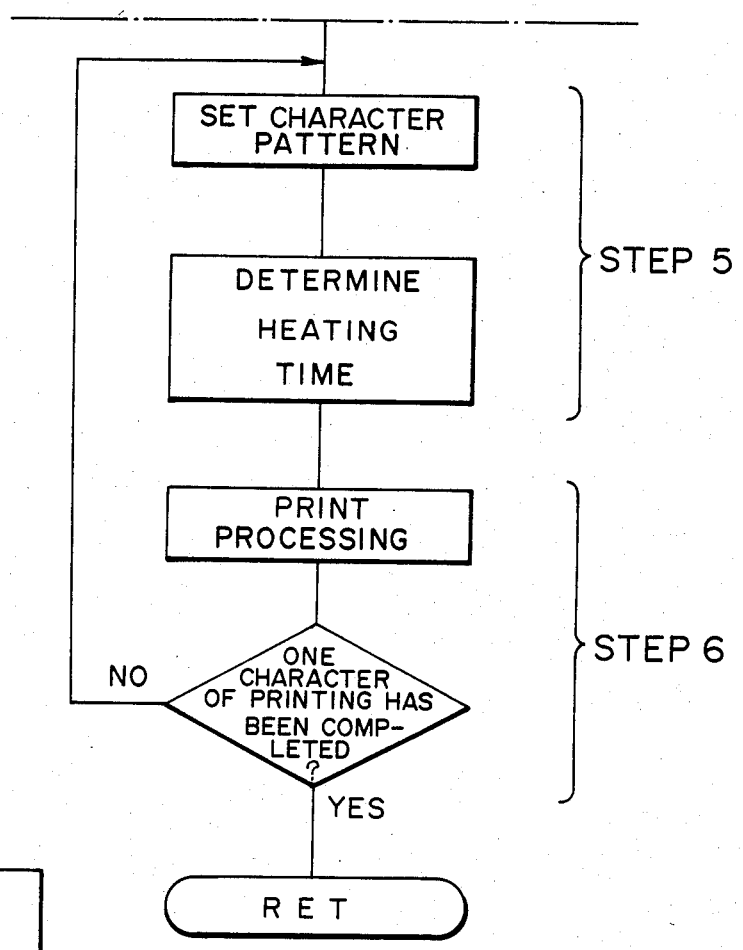
FIG. 7*a*, 7*b* is a flow chart for illustrating an operation of the thermal printer of FIG. 6.
Figure 7:
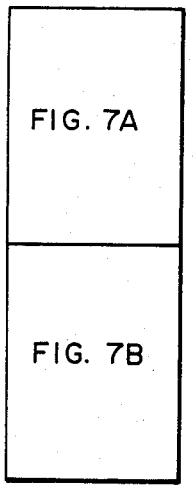
Figure 7A:
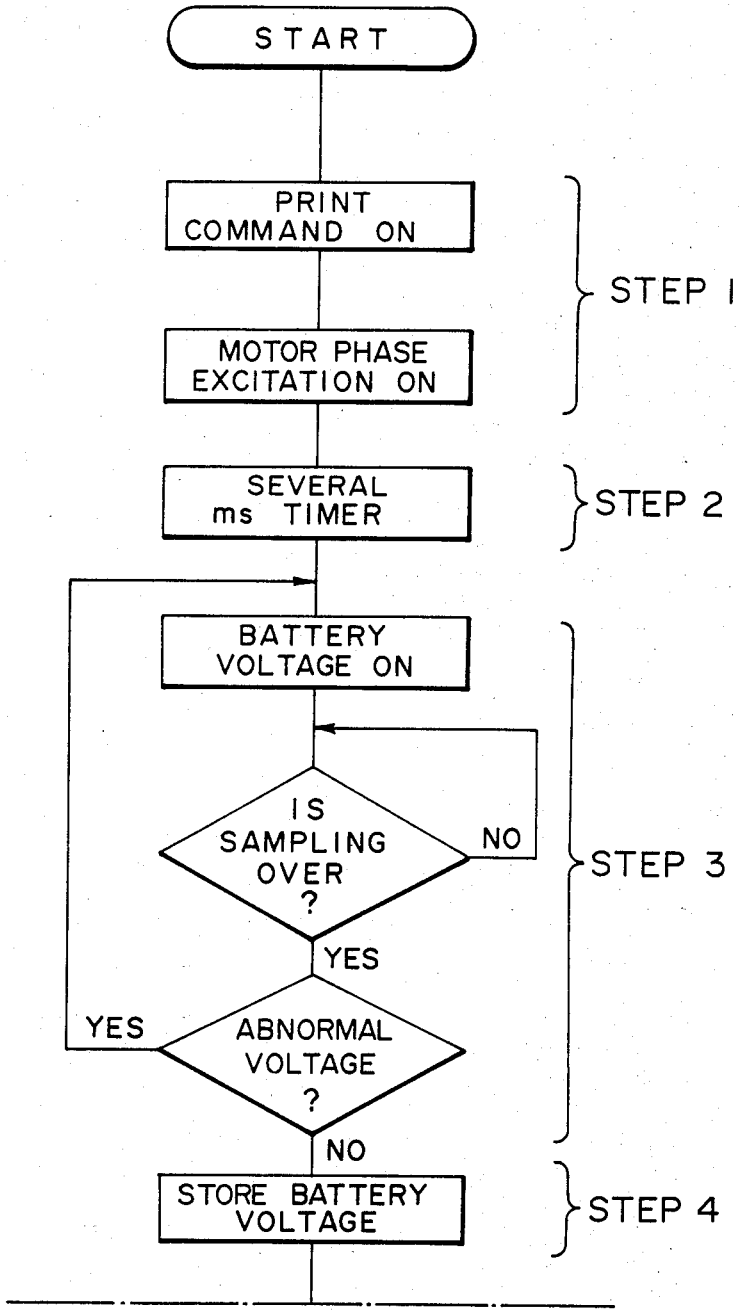
Figure 8:
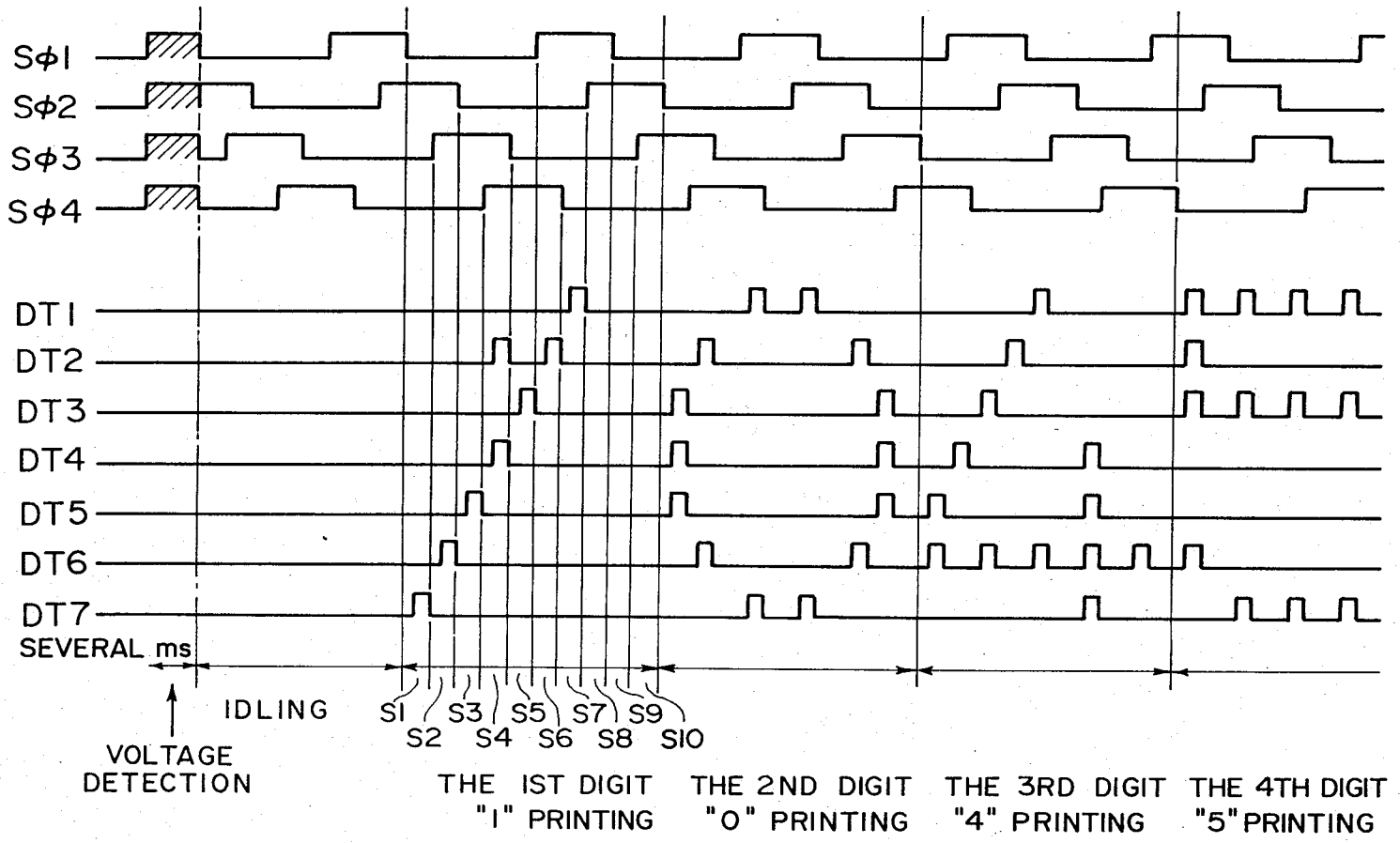
FIG. 8 is a time chart showing a time relation at various points in the thermal printer of FIG. 6.

The operation of the thermal printer of FIG. 6 is now explained with reference to a flow chart of FIG. 7 and a timing chart of FIG. 8.

In response to a print command issued from the HOST 1 through the signal line $S_1$, the CPU 2 provides a command to the battery voltage detector 3 through the signal line $S_2$ to detect the voltage of the battery 4. The CPU 2 also issues a signal to the driver 5 through the signal line $S_3$ to impart a dummy load which is equivalent to a load in a print mode and to apply the output voltage of the battery 4 to the pulse motor 6 to excite four phases Sϕ1–Sϕ4 of the pulse motor 6 at a timing shown by hatching in the time chart of FIG. 8(step 1).

In an actual print operation, two phases of the pulse motor 6 and the simultaneously energized dots of the thermal head 7 are imparted as the load and this load is substantially equivalent to the load imparted when the four phases Sϕ1–Sϕ4 are excited. The pulse motor 6 is thereafter excited at the timings shown by Sϕ1–Sϕ4 in FIG. 8 to drive the thermal head 7. The relation between the resistance of the windings of the pulse motor 6 and the resistance of the thermal head 7 is shown in the table above. After the output voltage of the battery 4 has been applied to the pulse motor 6, the dummy load is imparted for several milliseconds until the detection voltage is stabilized and then the voltage is detected (step 2). Because of possible variation of the stabilization time, the dummy load step and the voltage detection step are repeated. Then, an average of those voltages is calculated to determine the battery voltage or a reference voltage under the predetermined load (step 3). The detection voltage V′ is given by $$V' = \frac{V_o - V_d}{1 + \frac{r}{R}} + Vd$$

where Vd is a voltage drop across the driver which drives the pulse motor 6 and the thermal head 7, Vo is the terminal voltage of the battery, r is the internal resistance of the battery, and R is the resistance of the thermal head 7 and the pulse motor 6.

When the battery voltage detector 3 sends an end of detection signal to the CPU 2, the CPU 2 stores the detected value in the RAM 8 (step 4). The CPU 2 reads out the character code supplied from the HOST 1 through the signal line S1 and stored in the RAM 8, and in accordance with the character code, a character pattern shown in FIG. 9 stored in the ROM 9 which is a character generator is read out, and an energization pulse is applied to the driver 5 through the signal line $S_4$ such that a first heating cycle for one dot is effected in an optimum heating time determined by the CPU 2. The CPU 2 then checks if one character of printing has been completed, and if not, the above operation is repeated as seen from FIG. 8, the above operation is repeated ten times to complete one character of printing (step 6) because the character pattern stored in the ROM 9 comprises a dot pattern of 8 rows by 10 columns.

Figure 1:
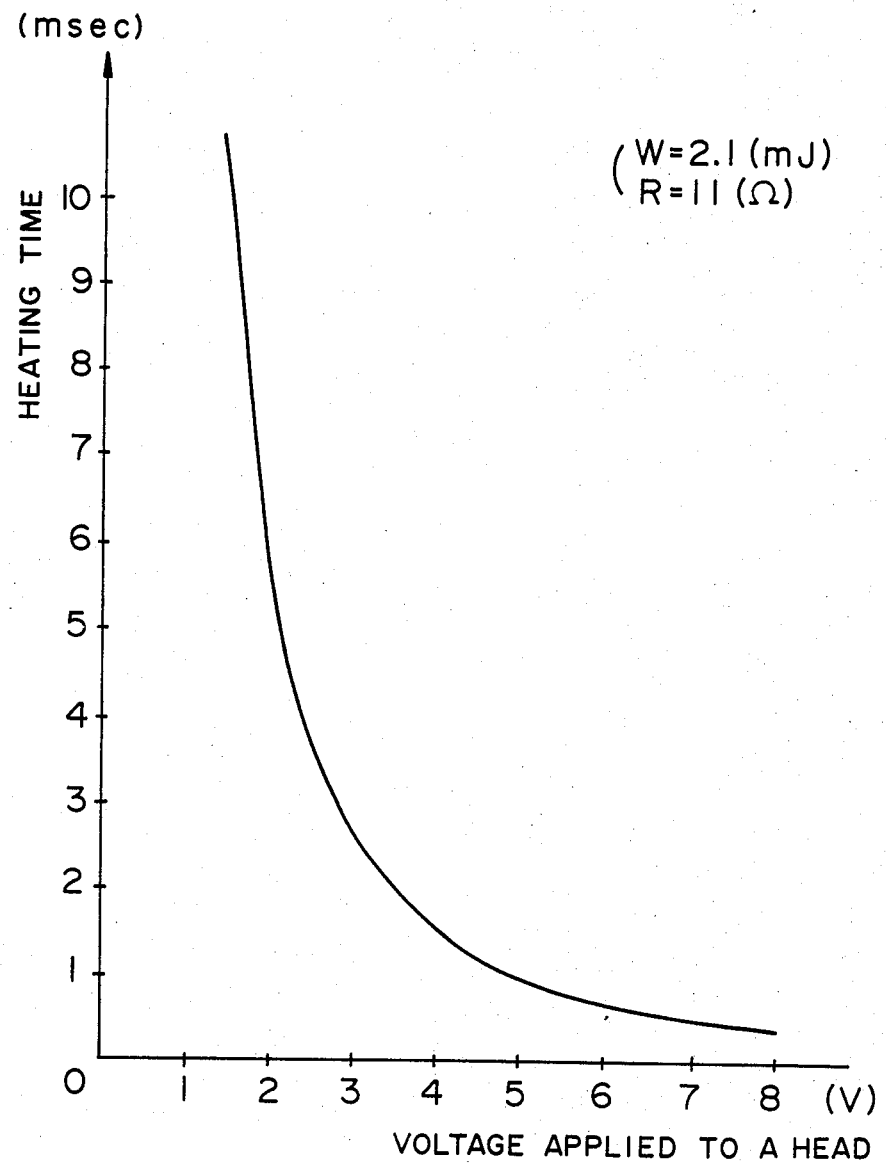
FIG. 1 is a graph showing the relation between a voltage applied to a head and a heating time.
Figure 2:
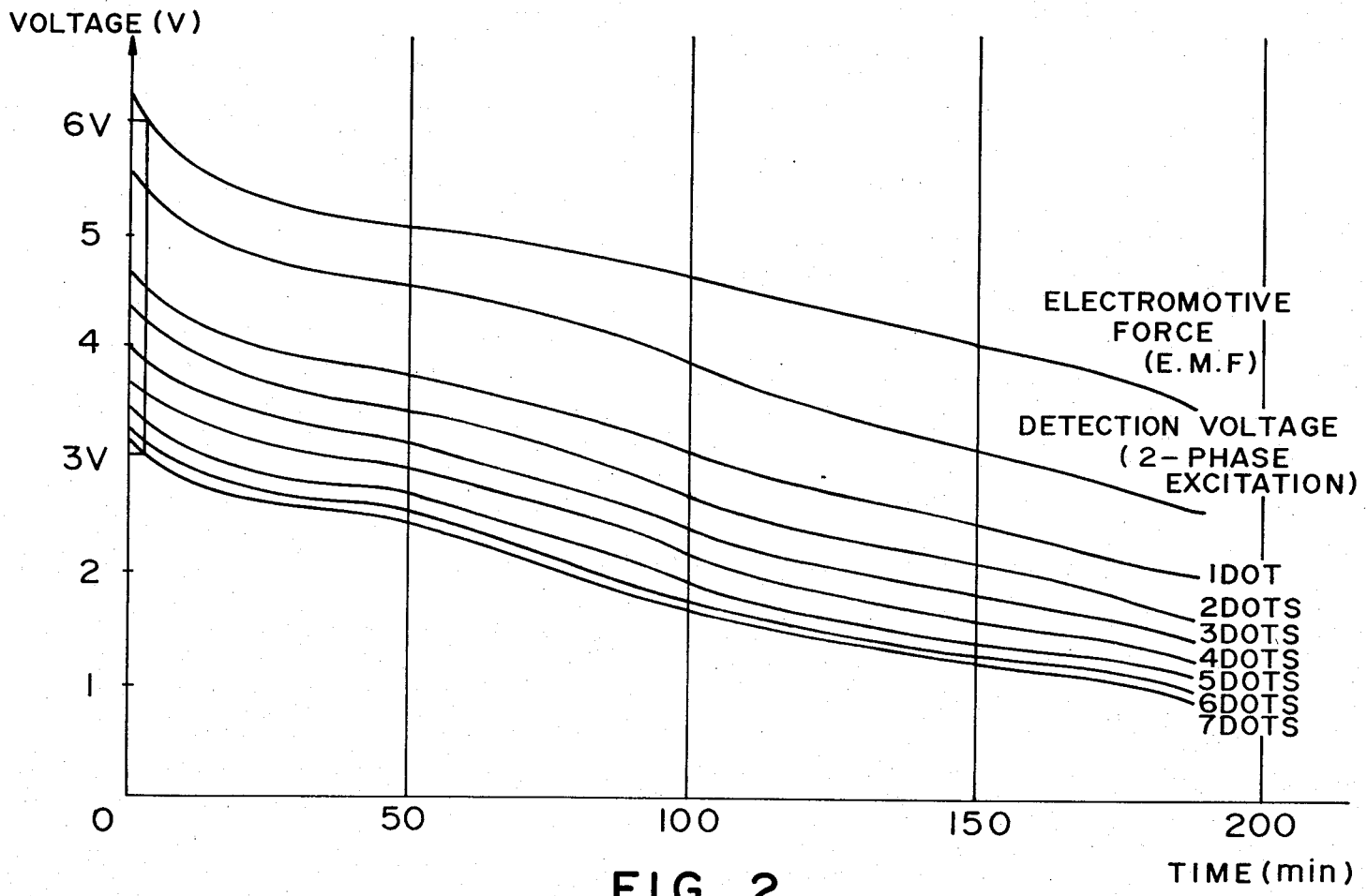
FIG. 2 is a graph showing the relation between the number of simultaneously energized dots and the voltage applied to the head.
Figure 3:
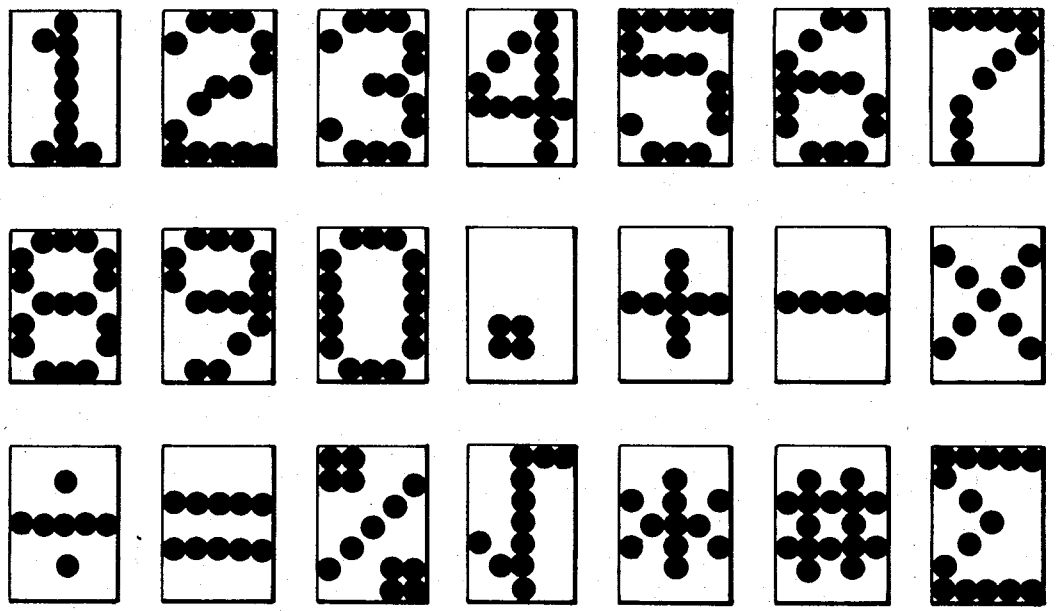
FIG. 3 shows an example of a character font used in a desk-top calculator.
Figure 4:
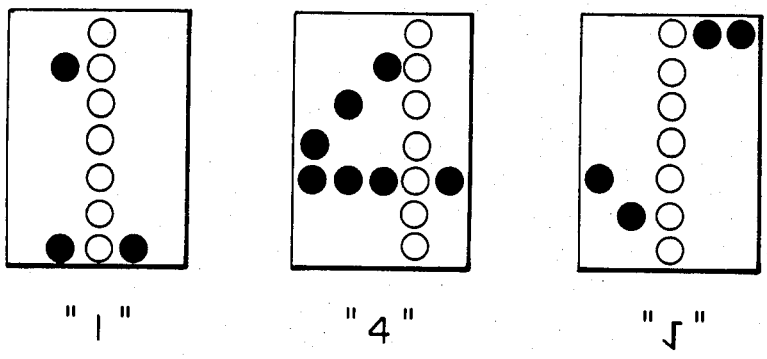
FIG. 4 shows printouts of characters "1", "4" and "√" printed in a conventional print control method.
Figure 5:
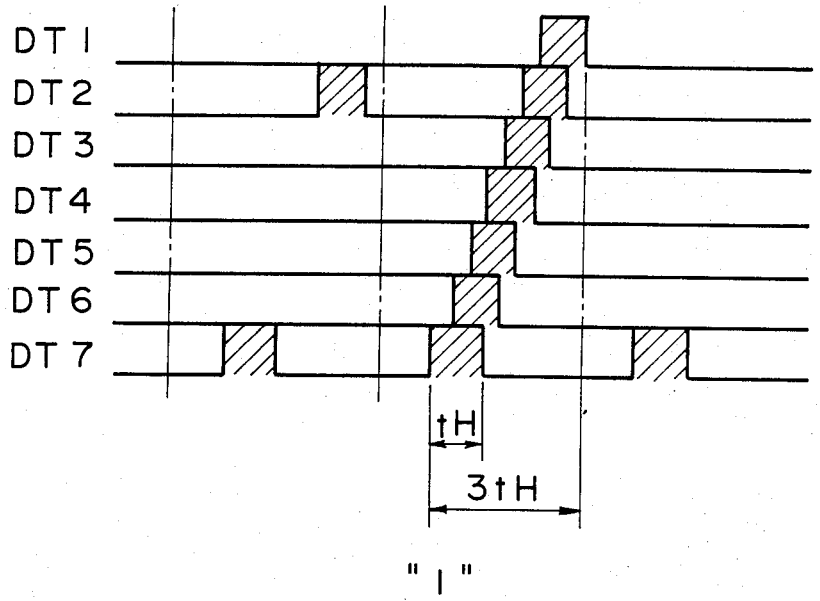
FIG. 5 is a time chart in a time division control method.

The character patterns stored in the ROM 9 and shown in FIG. 9 are now explained in detail. As seen from FIG. 9, all seven dots are not arranged in any column of any character pattern. To compare FIG. 3 with FIG. 9, the seven dots in one column of the character pattern "1" in FIG. 3 are distributed to a plurality of columns in FIG. 9. As to the character patterns "4" and "√", the seven dots in one column in FIG. 3 are reduced to four dots in FIG. 9. In the character patterns stored in the ROM 9 of the present invention, the number of dots in any column is no more than four as shown in FIG. 9. This dot configuration is not limited to the character patterns shown in FIG. 9 but it is equally applicable to other characters such as alphabetic characters. The number of dots in one column of the character pattern is determined such that the variation of the print density, which occurs when the number of simultaneously energized heat generating elements of the thermal head is large, is suppressed. When the number of dots constituting one column of the character pattern is m (larger than seven), the number of dots arranged in one column is selected to $m \times 4/7$ so that the same effect as described above is attained. In the present embodiment, the heat generating resistive elements of the thermal head are arranged in the vertical line. If they are arranged in a horizontal column, the number of dots arranged in one such column of the character dot pattern may be reduced in accordance with the teaching of the present invention.

While the present invention has been described in connection with the thermal printer, the present invention is equally applicable to a wire dot printer. In the wire dot printer, the print density varies depending on the number of simultaneously driven wires. By using the character patterns shown in FIG. 9, the above problem is resolved.

According to the present invention, the number of simultaneously energized dots of a character pattern which inherently has a large number of simultaneously energized dots is reduced. Accordingly, a dot printer which prints characters with small print density variations and at a high speed is provided.

I claim:

1. A dot printer comprising:

a head having m print elements arranged in a column;

memory means for storing data to be printed by said head;

pattern generating means for generating a plurality of dot patterns, each having n columns by m rows of dots, for the data stored in said memory means, the number of dots in any column of any dot pattern being less than m; and drive means for driving said print elements of said head in accordance with the dot pattern generated by said pattern generating means.

2. A dot printer according to claim 1 further comprising a motor for driving said head in a direction of print scan.

3. A dot printer according to claim 2 wherein said motor is a multi-phase pulse motor.

4. A dot printer according to claim 1 wherein said head is a thermal head and said print elements are heat generating elements.

5. A dot printer according to claim 1 further comprising:

power supply means for supplying power to said head and said memory means, said pattern generating means and said drive means;

power supply voltage detecting means for detecting the voltage of said power supply means; and control means for calculating an average value of the voltages detected by said power supply voltage detecting means a plurality of times and controlling a drive time period to drive said head in accordance with said average value.

6. A dot printer comprising:

a head having m print elements arranged in a column;

memory means for storing a data to be printed by said head;

pattern generating means for generating a plurality of dot patterns, each having n columns by m rows of dots, for the data stored in said memory means, the number of dots in any column of any dot pattern being no more than $m \times 4/7$; and drive means for driving said print elements of said print head in accordance with the dot pattern generated by said pattern generating means.

7. A dot printer according to claim 6 further comprising a motor for driving said head in a direction of print scan.

8. A dot printer according to claim 7 wherein said motor is a multi-phase pulse motor.

9. A dot printer according to claim 6 wherein said head is a thermal head and said print elements are heat generating elements.

* * * * *

UNITED STATES PATENT AND TRADEMARK OFFICE

CERTIFICATE OF CORRECTION

PATENT NO. : 4,543,588
DATED : September 24, 1985
INVENTOR(S) : HIROSHI FUKUI

It is certified that error appears in the above-identified patent and that said Letters Patent is hereby corrected as shown below:

Column 1, line 32, insert line: --The heat per dot W(mJ) is given by--.

Column 2, line 23, change "numberals" to --numerals--.

Column 5, line 5, change "peated as" to --peated. As--.

Column 6, line 35, delete "a".

In the abstract, line 5, change "columns" to --column--.

Signed and Sealed this

*Twenty-sixth* Day of *August 1986*

[SEAL]

*Attest:*

DONALD J. QUIGG

*Attesting Officer*

*Commissioner of Patents and Trademarks*